United States Patent [19]

Hamlin

[11] Patent Number: 4,823,663

[45] Date of Patent: Apr. 25, 1989

[54] CUT SHEET ROLL SUPPLY

[75] Inventor: Thomas J. Hamlin, Macedon, N.Y.

[73] Assignee: Xerox Corporation, Stamford, Conn.

[21] Appl. No.: 20,805

[22] Filed: Mar. 2, 1987

[51] Int. Cl.[4] ..... B26D 5/26

[52] U.S. Cl. ..... 83/208; 83/215; 83/283; 83/649; 83/694

[58] Field of Search ..... 83/283, 208, 211, 215, 83/649, 694

[56] References Cited

U.S. PATENT DOCUMENTS

| | | | |
|---|---|---|---|
| 629,532 | 7/1899 | Thomas . | |
| 2,026,402 | 12/1935 | Schlemmer | 83/156 |
| 2,137,724 | 11/1938 | Lester et al. | 83/283 X |
| 2,776,003 | 1/1957 | Koster | 164/17 |
| 2,810,437 | 10/1957 | Hoitt | 83/694 X |
| 3,194,103 | 7/1965 | Gilman | 83/694 X |
| 3,799,022 | 3/1974 | Nagel et al. | 83/583 |
| 3,830,124 | 8/1974 | Ravera et al. | 83/205 |
| 3,920,136 | 11/1975 | Talbert | 242/55 |
| 4,066,220 | 1/1978 | Beck et al. | 242/55 |
| 4,604,929 | 8/1986 | Vallance | 83/524 |

*Primary Examiner*—Donald R. Shran
*Attorney, Agent, or Firm*—Frederick E. McMullen

[57] ABSTRACT

A roll supply having a pair of idler belts for supporting a supply roll of sheet material, stationary and movable knife blades, the latter having a V-shaped cutting edge, an eccentric for reciprocating the movable knife blade in one direction into cutting relation with the stationary knife blade, the movable knife blade having projections which rest on the stationary knife blade, a spring biasing the movable knife blade against the stationary knife blade, the movable knife blade being made of spring steel deformed into a slight V-shape relative to the stationary knife blade so that as the movable blade is reciprocated, the movable blade is displaced in a direction substantially normal to the direction of blade movement and a pair of cutting points are established which move together at the center, severing the sheet material, first and second roll pairs for advancing the sheet material to a cutting position, and control for actuating the roll pairs and the eccentric to cut the sheet length selected.

13 Claims, 4 Drawing Sheets

CUT SHEET ROLL SUPPLY

The invention relates to a roll supply for cut sheets, and more particularly to an improved roll supply for supplying on demand cut sheets of selected size.

Supplying relatively large size sheets such as used to make engineering drawings normally requires, because of the large sheet size, that the sheet material be supplied uncut in the form of a roll. As a result, it is necessary that the sheet material be cut to size from the roll before being used, and for this purpose, a cut sheet roll supply is desirable. Typically a cut sheet roll supply of the type referred to herein includes a roll support which holds and permits the roll to be unwound as sheets are cut therefrom, a sheet such as a guillotine which cuts or severs the sheet material in two, a sheet handling apparatus for unwinding the sheet material from the supply roll and advancing a length selected to the sheet cutter, and a machine control system for integrating and synchronizing operation of the various components, the later including some type of selector means to enable the operator or user to choose the size of the sheet to be cut.

Roll supplies of the type alluded to may be in the form of an off line stand along unit or may be integrated with and made part of the end user, as for example, a copier or printer. Since the demand for cut sheets of various sizes, at least in most industrial application, is normally heavy and the volume of cut sheets processed high, it is desirable that the roll supply be as automated as possible, preferably requiring only that the operator select the size to be cut and actuate the roll supply. And, since rolls of uncut sheet material are usually large and heavy and difficult to handle, it is necessary that loading of a fresh roll be as simple and as easy as possible. In this context, one convenient and very desirable feature is automatic threading of the new roll leader as well as the ability to handle the large rolls of sheet material without the need for spindles, cores, and the like. It is also especially desirable that the roll supply be able to process, with the utmost reliability and accuracy, a wide range of sheet materials such as vellum, film, and the like in addition to a wide range of paper weights. And, modern convenience features such as push button size selection, quick change capability, self-sharpening blades, etc. are highly desirable.

In the prior art that relates to roll supplies and guillotine cutters, U.S. Pat. No. 3,830,124 to Ravera et al discloses a copying machine of the type that employs a photosensitive material as the photoconductor, with the photosensitive material being supplied from a roll and advanced through the various xerographic processing station after which the photosensitive material is severed by a rotating cutting knife. In a generally similar vein, U.S. Pat. No. 4,066,220 to Beck et al discloses a copy paper supplied to a copy machine from a roll, with a knife for cutting off the copy paper to desired length at a point upstream of the copy machines' transfer station. U.S. Pat. No. 4,604,929 to Vallance discloses a self-aligning guillotine knife with a succession of cutting teeth that are insertable into a like number of trangular grooves in an oppositely disposed anvil such that the pointed ends of the teeth first penetrate the web being cut and then, with continued movement of the knife, effects a series of ever larger slitlike cuts across the web. In other prior art, U.S. Pat. No. 3,799,022 to Nagel et al discloses a cutter for severing a paper web in which a pair of spaced apart counter knives form a gap into which a movable cutting knife enters such that two cuts are made simultaneously across the web, U.S. Pat. No. 629,532 to Thomas discloses a shear for punching out metal plates in which the punch surface is V-shaped along the front and inclined along the two sides, U.S. Pat. No. 2,776,003 to Koster discloses a tubing cutter in the form of a reciprocating W-shaped blade, and U.S. Pat. No. 3,920,136 to Talbert discloses an air cushion for a sheet roll designed to facilitate unwinding thereof.

The present invention provides an improved roll supply for supplying cut sheets of selected length for use by machines such as copiers and printers, comprising, incombination: a housing having a sheet discharge for the discharge of cut sheets; support means in the housing for rotatably supporting a roll of sheet material with the roll being free to rotate on the support means; sheet cutting means in the housing for cutting off a selected length of the sheet material material from the supply roll, the cutting means including a stationary knife, a movable knife in opposed relation to the stationary knife, means supporting the movable knife for multidirectional movement; means for imparting substantially reciprocating movement to the movable knife to cause the movable knife to move in a first direction into and out of cutting relation with the stationary knife to cut the selected length of sheet material from the roll, and biasing means urging the movable knife in a second direction substantially normal to the first direction whereby the stationary and movable kinves are biased into cutting relation with one another; first sheet feeding means upstream of the sheet cutting means for withdrawing sheet material from the supply roll and feeding the sheet material to the sheet cutting means; second sheet feeding means downstream of the sheet cutting means for feeding the sheet material from the cutting means toward the sheet discharge; and means responsive to feeding the selected length of sheet material from the supply roll to the cutting means by the first and second sheet feeding means to actuate the sheet cutting means and cut off the length of the sheet material selected.

Figure 1:
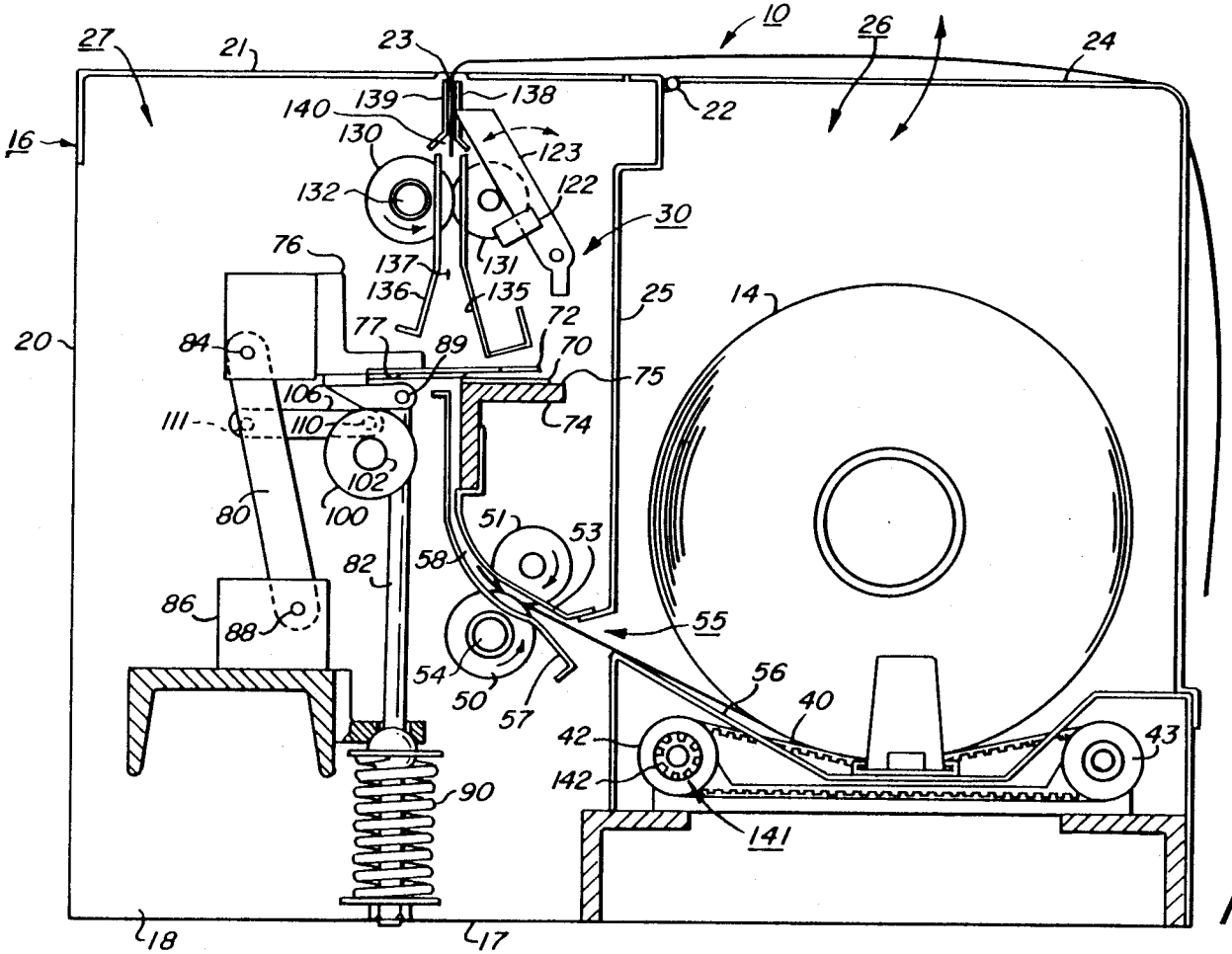
FIG. 1 is a side view in cross section of the roll supply of the present invention showing details of the sheet roll support, the sheet cutter and cutter drive mechanism, and the sheet feeding and handling apparatus.
Figure 2:
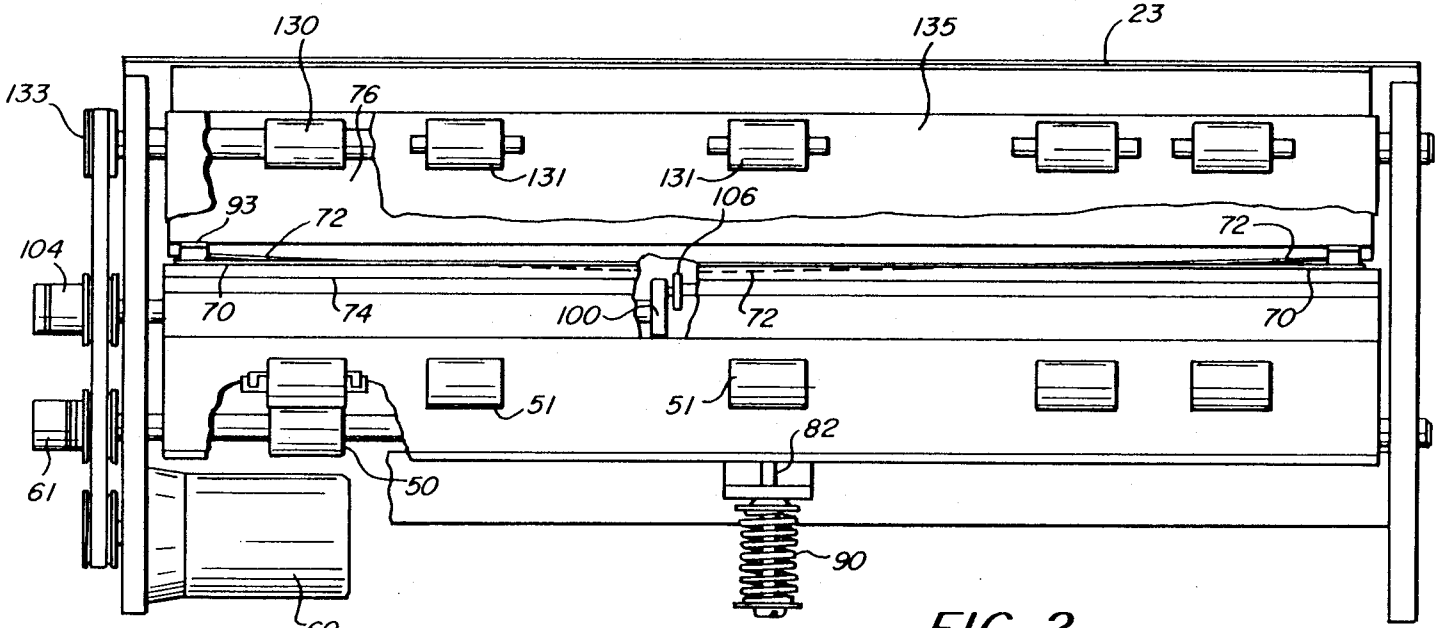
FIG. 2 is a top view of the roll supply shown in FIG. 1 illustrating details of the operating drives for the sheet feeding and handling apparatus and the cutter drive mechanism.

Referring to FIGS. 1 and 2 of the drawing, there is shown the roll supply, designated generally by the numeral 10, of the present invention. As will appear, roll supply 10 is adapted to provide cut sheets 12 of any desired length from a sheet supply roll 14. Roll supply 10 may be either a stand alone unit as illustrated herein or may be integrated into and made part of the end user such as a copier or printer (not shown).

Cutter 10 has a generally rectangular shaped frame or housing 16 with base 17, vertical sides 18 and rear wall 20. A top cover 21 has a sheet discharge slot 23 through which the cut sheets are discharged for removal by the operator as will appear. An interior wall 25 separates housing 16 into sheet supply and cutter compartments 26, 27 respectively, the lower part of wall 25 being turned inwardly and upwardly to form a curved sheet guiding baffle 53 which cooperates with a lower guide 56 in compartment 26 to provide an opening 55 through which the sheet material passes from supply roll 14 in compartment 26 to the cutter mechanism 30 in compartment 27. Sheet supply compartment 26 has a combination front wall and cover 24 pivotally attached to housing 16 at 22 to provide access to sheet supply roll 14 as when loading a fresh roll, or for servicing, etc. A complementary curved lower sheet guiding baffle 57 is spaced opposite baffle 53 and cooperates with baffle 53 to form a sheet passage 58 for guiding the sheet material to cutter mechanism 30.

Sheet supply roll 14 is supported by a pair of belts 40 in sheet supply compartment 26. Each belt 40 is spaced apart from the other by a distance sufficient to support roll 14 in a substantially level condition without the use of other supports such as a mandrel. Belts 40 are stretched across a pair of spaced idler rolls 42, 43.

A sheet feed roll pair 50, 51 is provided in cutter compartment 27 adjacent opening 55, roll pair 50, 51 forming sheet feeding nip for advancing the sheet along the passage 58 formed by sheet guiding baffles 55, 57 to cutter mechanism 30. Drive shaft 54 of roll 50 is drivingly coupled to the cutter main drive motor 60 through an electro-magnetic type clutch 61 to rotate roll 50, and through contact of roll 50 with roll 51, roll 51 in the direction shown by the arrow on energization of motor 60 and actuation of clutch 61.

Cutter mechanism 30 is a guillotine type cutter having oppositely disposed stationary and movable cutting blades or knives 70, 72 respectively. Stationary blade 70 comprises a substantially flat blade-like member mounted on the horizontal upper surface 75 of support 74 fixedly secured in housing 16, support 74 having a generally inverted L-shape when viewed in cross section. Movable blade 72 comprises a substantially flat blade-like member formed from a suitable spring steel mounted opposite stationary blade 70 on the lower surface 77 of a movable support 76, support 76 having a generally L-shape when viewed in cross section. Support 76 has both a reciprocating type movement in which blade 72 moves back and forth across blade 70 to effect cutting or severing of the sheet material therebetween, and a floating type up and down movement in a direction substantially perpendicular to the direction in which blade 72 reciprocates. For this purpose, support 76 is carried by a link 80 pivotally attached thereto by journal pin 84, the opposite end of link 80 being attached to frame member 86 by journal pin 88. Pins 84, 88 permit support 76 together with blade 72 to move back and forth in a reciprocating manner with respect to blade 70 and to pivot or swing up and down about pin 84.

A bias rod 82 is pivotally attached to support 76 at a point forward of link 80 by journal pin 89. A compression spring 90 is connected to the opposite end of rod 82, spring 90 being secured to base 17 of housing 16. Spring 90 causes bias rod 82 to exert a downward bias or force on support 76 tending to pull the blade 72 downwardly into contact with stationary blade 70. Blade 72 has an extension 93 projecting from each end thereof (seen also in FIG. 3), the length of extensions 93 being such that extensions 93 engage and rest upon the upper surface 71 of stationary blade 70 to support blade 72 when blade 72 is in the retracted position.

Blade 72 is driven in a reciprocating manner by means of an eccentric 100 mounted on a drive shaft 102. Drive shaft 102, which is rotatably journaled in housing 16, is driven by main drive motor 60 through an electromagnetic controlled single revolution clutch 104. A connecting rod 106, which is rotatably secured to eccentric 100 and link 80 by journal pins 110, 111, drivingly couples eccentric 100 to link 80.

Figure 3:
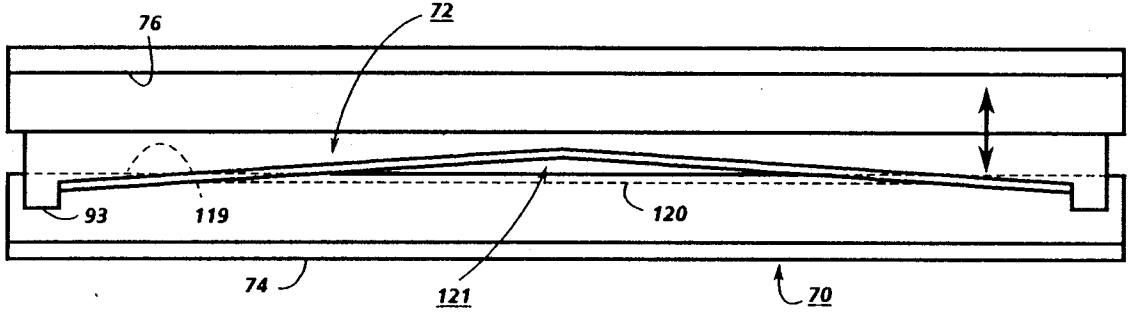
FIG. 3 is a front view of the cutter upper and lower knife blades.
Figure 4:
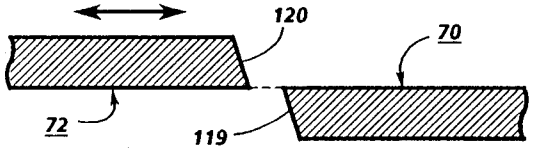
FIG. 4 is a view showing the knife edges on the cutter knife blades and the cutting relationship therebetween.

Referring particularly to FIGS. 3 and 4, stationary blade 70 has a beveled leading edge forming a cutting edge 119. Movable blade 72 similarly is provided with a beveled leading edge forming a cutting edge 120, edges 119, 120 cooperating with one another to establish a shearing or slicing action as blade 72 moves forward across the top of the stationary blade 70 as will appear. Cutting edge 120 of blade 72 has an inverted V-shape (identified by numeral 121 in FIG. 3) with extensions 93 projecting from each end thereof as described above.

Figure 5:
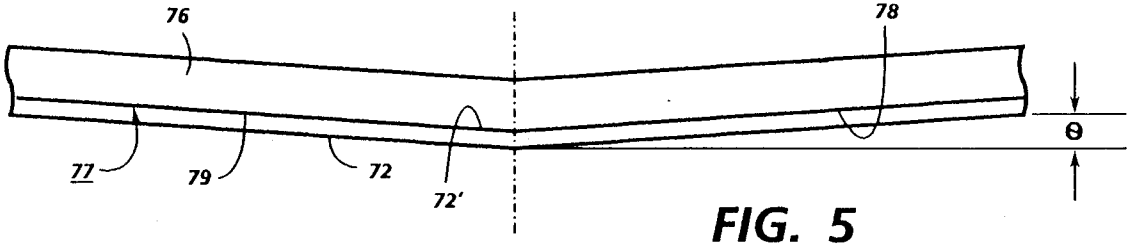
FIG. 5 is a view illustrating the V-shaped blade supporting surface with the cutter upper blade attached and deformed into a slight V-shape.

Referring particularly to FIGS. 2 and 5, the blade supporting surface 77 of support 76 is smooth, surface 77 being in the form of a V with a pair of oppositely sloping segments 78, 79 extending from the outer edges to the midpoint. The angle of incline of the sloping segments 78, 79 of blade supporting surface 77 is relatively small, an angle $\theta$ of 1° 30 min. relative to the horizontal having been found suitable.

Blade 72 is mounted on support 76 with the upper surface 72 of blade 72 against the surface 77 of support 76 and the cutting edge 120 projecting outwardly toward the cutting edge 119 of stationary blade 70. Blade 72 is securely attached to support 76 along its length as by means of screws (not shown) causing blade 72 to bend in conformance with the surface 77 so that blade 72 assumes a slightly V-shape when viewed in a direction parallel to the direction of blade movement.

Since the movement support 76 of blade 72 is capable of a pivoting type up and down movement about pin 84 and because blade 72 has a slight V-shape as compared with stationary blade 70 which is straight, a two-point contact is established between the cutting edges 119, 120 of blades 70, 72 as blade 72 is driven forward when edges 119, 120 first engage. The two point contacts, which start at the ends of the cutting edges 119, 120, converge toward one another as the blade 72 moves forward during the cutting cycle. This contact between blades 70, 72 raises of lifts blade 72 against the bias imposed by spring 90 as blade 72 moves forward, causing the forward end of support 76 to pivot about pin 84. Thus, the force that occurs on blade 72 as blade 72 is moved forward during the cutting stroke is accommodated by the ability of support 76 with blade 72 to swing or pivot about pin 84. As a result, a dual shearing or scissoring action is created which cuts the sheet material between the blades at two points starting at the sheet edges and advancing toward the center. The bias exerted by spring 90 on blade 72 through bias rod 82 maintains the blades 70, 72 in tight shearing engagement with one another as blade 72 moves forward.

Referring again to FIGS. 1 and 2, a sheet discharge roll pair 130, 131 is provided adjacent the exit of cutter mechanism 30 for feeding the leading edge of the sheet through discharge slot 23 as the leading edge of the sheet material is being advanced into place for cutting. Roll 130 is supported on a drive shaft 132 drivingly coupled to motor 60 through an electro-magnetic type clutch 133. On energization of clutch 133, roll 130 is rotated, and through engagement of roll 130 with roll 131, rotates roll 131 in the direction shown by the arrow. A pair of baffles 135, 136 cooperate to form a sheet discharge passage 137 for guiding the sheet into the nip formed by roll pair 130, 131. A discharge baffle pair 138, 139 cooperate to form a passage 140 for guiding the sheet leading edge from roill pair 130, 131 to discharge slot 23, baffles 138, 139 being spaced closely together so that the passage 140 is relatively small and serves as a retainer for preventing the cut sheet from slipping off of cover 21 by its own weight.

Figure 6:
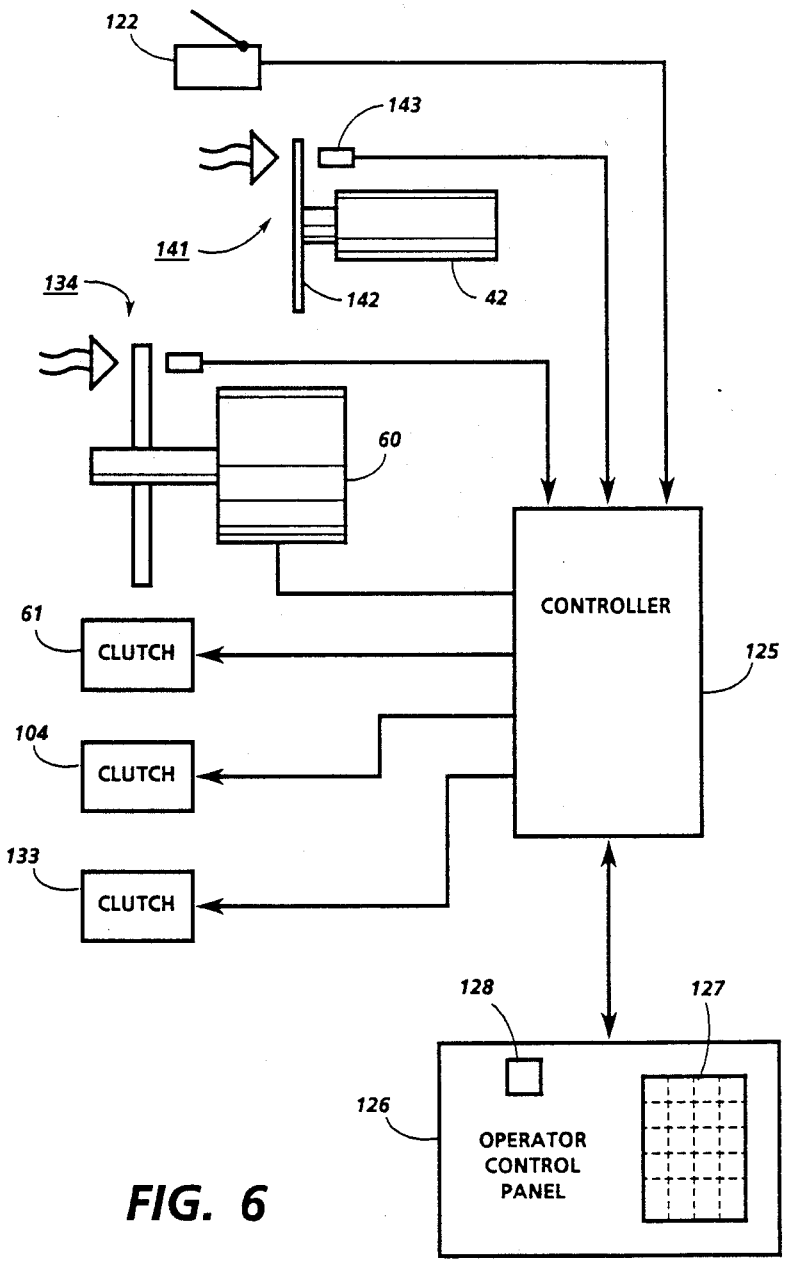
FIG. 6 is a circuit schematic showing details of the control system for the roll supply of the present invention.

Referring particularly to FIG. 6, a suitable controller 125 is provided for controlling operation of roll supply 10 in response to program instructions input by the operator or user, a control panel 126 being provided for this purpose. Controller 125 controls and synchronizes operation of drive motor 60, and clutches 61, 104, and 133 in accordance with the program instructions from control panel 126. To enable the length of the cut sheet to be selected, panel 126 is provided with a suitable sheet length selector (illustrated here in the form of a keyboard 127) which permits the user or operator, by actuating certain keys or key combinations, to select the length of the sheet material from supply roll 14 to be cut. A start button 128 controls startup of roll supply 10. A suitable device such as encoder 134 monitors the length of the sheet material fed forward to cutter mechanism 30, the signal output of encoder 134 being input to controller 125. Controller 125 terminates feeding of the sheet material from supply roll 14 when the length of the sheet material fed to cutter mechanism 30 equals the length programmed for processing.

A switch 122 is provided for detecting the presence or absence of sheet material in the sheet discharge passage 140, switch 122 having a movable actuating arm 123 extending into discharge passage 140. As the leading edge of the sheet material passes through discharge passage 140, switch arm 123 is displaced (in the direction shown by the dotted line arrow) by the sheet material, actuating switch 122. The output of switch 122 is coupled to controller 125.

To detect jams or other interruptions in the feeding of the sheet material to cutter mechanism 30, a motion sensor 141 is provided to detect movement of roll 14. Motion sensor 141 has a disc 142 with a succession of teeth or notches about the circumference thereof attached to and rotatable with belt supporting idler roll 42. A photosensor 143 looks at disc 142 and outputs a pulse-like signal to controller 125 on movement of the toothed portion of disc 142 therepast.

OPERATION

In the operation of roll supply 10, and with a sheet supply roll 14 positioned in sheet supply compartment 26 on belts 40, the leading edge of the sheet material is threaded through sheet opening 55 and into the nip of feed roll pair 50, 51. With the leading edge of the sheet material properly engaged with feed roll pair 50, 51, roll supply 10 is ready for operation.

The operator, using keyboard 127 on control panel 125, programs in the length of the cut sheet 12 desired. Start button 128 is actuated and controller 125 actuates motor 60 and engages clutches 61, 133 of feed roll pairs 50, 51 and 130, 131. Engagement of clutches 61, 133 couples sheet feed roll pairs 50, 51 and 130, 131 to motor 60 to rotate roll pairs 50, 51 and 130, 131 in the direction shown by the solid line arrows in FIG. 1.

Sheet feed roll pair 50, 51 advances the sheet material from supply roll 14 forward through the passage 58 formed by baffles 53, 57 to cutter mechanism 30. There, the leading edge of the sheet material passes between stationary blade 70 and the now retracted blade 72 of the cutter mechanism 30. As the sheet material continues to be fed, the leading edge of the sheet material passes along the sheet discharge passage 137 formed by baffles 135, 136 and into the nip of discharge sheet feed roll pair 50, 51 to advance the leading edge of the sheet material through the reduced size passage 140 formed by baffles 138, 139 and out through the discharge slot 23 in top cover 21. As the sheet material enters discharge passage 140, the leading edge actuates switch 122.

With start up of motor 60, encoder 134 emits a succession of signal pulses, each plate corresponding to an incremental length of the sheet material advanced. Controller 125 counts the number of signal pulses and compares the count with a count representing the length of sheet material programmed for cutting by the operator through control panel 125. When the counts match, the length of sheet material fed equals the length programmed by the operator and controller 125 disengages clutches 61, 133, stopping sheet feed roll pairs 50, 51 and 130, 131 and terminating the advance of the sheet material.

With the advance of the programmed length of sheet material completed, controller 125 engages one revolution clutch 104 to couple drive shaft 102 to motor 60 and rotate eccentric 100 through a single revolution. Rotation of eccentric 100 acts through connecting rod 106 and link 80 to drive blade 72 forward across the upper surface 71 of the stationary blade 70. As blade 72 moves forward across blade 70, the cutting edges 119, 120 of blades 70, 72 respectively shear or cut the sheet material therebetween, such shearing action starting first at the outer ends of the sheet and progressing inwardly toward the middle while eccentric 100 completes the first half of the cutting cycle. With the cut completed, the continued rotation of eccentric 100 reverses the direction of movement of connecting rod 106, retracting blade 72 and returning cutter mechanism 30 to a rest position ready for the next cut.

The cut sheet typically lays on cover 21 and the combination front wall and cover 24 ready for removal by the operator. Where the cut sheet length selected is relatively long, the excess sheet material normally extends down the front of the cutter. As will be understood, the part of the cut sheet that extends down imposes a force which tends to pull the rest of the sheet down with it onto the surface, such as the ground, that roll supply 10 rests on. To inhibit this, the size of the sheet discharge opening 140 that is formed by baffles 138, 139 is made relatively small to establish, adjacent the point where the cut sheet bends as the sheet leaves discharge opening 23, a frictional retarding or braking force which tends to releasably keep the trailing edge of the cut sheet from being drawn out of the roll supply 10. So long as the previously cut sheet material remains in discharge slot 23, switch 122 is actuated and controller 125 precludes startup of the roll supply 10.

As the sheet material is being advanced, the supply roll 14 resting on belts 40 rotates freely as sheet material is unwound, belts 40 moving therewith and rotating idler rolls 42, 43. With rotation of idler roll 42, disc 142 rotates causing photosensor 143 to output signal pulses to controller 130. Should the leading edge of the sheet material fail to reach switch 122 in a preset interval following start of feeding of the sheet material indicating a fault such as a jam or should the signal output of photosensor 143 be interrupted during the feeding of a programmed length of sheet material to cutter mechanism 30 indicating a fault such as a jam, controller 125 shuts down roll supply 10.

While extensions 93 for supporting movable knife blade 72 are shown on blade 72, extensions 93 may instead be provided on stationary blade 70. And, while cutting edge 120 of blade 72 is illustrated as having an inverted V-shape, cutting edge 119 of blade 72 may instead be V-shaped.

While the invention has been described with reference to the structure disclosed, it is not confined to the details set forth, but is intended to cover such modifications or changes as may come within the scope of the following claims.

We claim:

1. A roll supply for supplying cut sheets of selected length to a machine, comprising, in combination:

(a) a housing having a sheet discharge for the discharge of cut sheets;

(b) support means in said housing for rotatably supporting a roll of sheet material with said roll being free to rotate on said support means;

(c) sheet cutting means in said housing for cutting off a selected length of said sheet material from said supply roll, said cutting means including:

(1) a substantially planar stationary knife;

(2) a movable knife in opposed relation to said stationary knife;

(3) means supporting said movable knife for multi-directional movement;

(4) means for imparting substantially reciprocating movement to said movable knife to cause said movable knife to move in a first direction into and out of cutting relation with said stationary knife to cut said selected length of sheet material from said roll; and (5) biasing means urging said movable knife in a second direction substantially normal to said first direction whereby said stationary and movable knives are biased into cutting relation with one another;

(d) first sheet feeding means upstream of said sheet cutting means for withdrawing sheet material from said supply roll and feeding said sheet material to said sheet cutting means;

(e) second sheet feeding means downstream of said sheet cutting means for feeding said sheet material from said cutting means toward said sheet discharge; and (f) means responsive to feeding said selected length of sheet material from said supply roll through said cutting means by said first and second sheet feed means to actuate said sheet cutting means and cut off said length of said sheet material, said movable knife having a relatively slight V-shape relative to the plane of said stationary knife whereby as said movable knife moves into and out of cutting relation with said stationary knife, contact between said movable and stationary knives progressively displaces said movable knife in said second direction to progressively cut said sheet material from each end toward the middle, each end of one of said stationary and movable knives being extended so as to provide a support for supporting said movable knife, said extended ends guiding said movable knife into cutting relation with said stationary knife during reciprocating movement of said movable knife while preventing face to face contact of said movable knife with said stationary knife.

2. The roll supply according to claim 1 in which one of said knives has a cutting edge that is substantially V-shaped whereby as said movable knife moves into and out of cutting relation with said stationary knife, contact between said movable and stationary knives progressively cuts said sheet material from each end toward the middle.

3. The roll supply according to claim 2 in which said movable knife supporting means includes (a) a rigid base on which said movable knife blade is mounted, and (b) a support link pivotally attaching said base to said housing whereby said support link cooperates with said knife extended ends to support said movable knife for said multi-directional movement.

4. The roll supply according to claim 3 in which said movement imparting means includes (a) an eccentric, (b) drive means for rotating said eccentric, and (c) a connecting link pivotally connected between said eccentric and said support link effective on rotation of said eccentric to impart said substantially reciprocating movement through said support link and said base to said movable knife.

5. The roll supply according to claim 4 in which said movement imparting means includes a one revolution clutch adapted when actuated to couple said eccentric with said drive means and rotate said eccentric through one revolution whereby to operate said cutting means through one cycle.

6. The roll supply according to claim 5 in which said biasing means includes (a) a bias rod attached to said base, and (b) spring means connected between said housing and said bias rod, said spring means imposing a biasing force through said rod and said base urging said movable knife in said second direction so that on movement of said movable knife, said stationary and movable knives are maintained in cutting relation with one another.

7. The roll supply according to claim 6 in which said bias rod is attached to said base between said support link and said movable knife cutting edge.

8. A roll supply for supplying cut sheets of selected length to a machine, comprising, in combination:

(a) a housing having a sheet discharge for the discharge of cut sheets;

(b) roll support means in said housing for rotatably supporting a roll of sheet material with said roll being free to rotate on said support means;

(c) sheet cutting means in said housing for cutting off a selected length of said sheet material from said supply roll, said cutting means including:

(1) a stationary knife;

(2) a movable knife in opposed relation to said stationary knife;

(3) means supporting said movable knife for multi-directional movement;

(4) means for imparting substantially reciprocating movement to said movable knife to cause said movable knife to move in a first direction into and out of cutting relation with said stationary knife to cut said selected length of sheet material from said roll; and (5) biasing means urging said movable knife in a second direction substantially normal to said first direction whereby said stationary and movable knives are biased into cutting relation with one another;

(d) first sheet feeding means upstream of said sheet cutting means for withdrawing sheet material from said supply roll and feeding said sheet material to said sheet cutting means;

(e) second sheet feeding means downstream of said sheet cutting means for feeding said sheet material from said cutting means toward said sheet discharge; and (f) means responsive to feeding said selected length of sheet material from said supply roll through said cutting means by said first and second sheet feed means to actuate said sheet cutting means and cut off said length of said sheet material, said roll support means including at least two pair of spaced apart supports, each of said supports including (g) at least two idlers, and (h) a flexible belt stretched between said idlers, said idlers being separated from one another by a distance such that each of said supports provides a belt run of a length sufficient to support said roll of sheet material.

9. A roll supply for supplying cut sheets of selected length to a machine, comprising, in combination:

(a) a housing having a sheet discharge for the discharge of cut sheets;

(b) support means in said housing for rotatably supporting a roll of sheet material with said roll being free to rotate on said support means;

(c) sheet cutting means in said housing for cutting off a selected length of said sheet material from said supply roll, said cutting means including:

(1) a stationary knife;

(2) a movable knife in opposed relation to said stationary knife;

(3) means supporting said movable knife for multi-directional movement;

(4) means for imparting substantially reciprocating movement to said movable knife to cause said movable knife to move in a first direction into and out of cutting relation with said stationary knife to cut said selected length of sheet material from said roll; and (5) biasing means urging said movable knife in a second direction substantially normal to said first direction whereby said stationary and movable knives are biased into cutting relation with one another;

(d) first sheet feeding means upstream of said sheet cutting means for withdrawing sheet material from said supply roll and feeding said sheet material to said sheet cutting means;

(e) second sheet feeding means downstream of said sheet cutting means for feeding said sheet material from said cutting means toward said sheet discharge; and (f) means responsive to feeding said selected length of sheet material from said supply roll through said cutting means by said first and second sheet feed means to actuate said sheet cutting means and cut off said length of said sheet material, and sheet guide means for guiding said sheet material from said supply roll to said cutting means and from said cutting means to said sheet discharge, said sheet guide means including a sheet guide pair adjacent said sheet discharge for releasably retaining said cut off length of said sheet material in said roll supply pending removal by the user.

10. A guillotine type cutter having a pair of knives relatively movable into and out of cutting relation with one another to sever a sheet material in two, in which:

(a) one of said knives comprises a substantially flat continuous knife blade of predetermined length having a cutting edge along one side, said knife blade being formed from a flexible material;

(b) a support for said knife blade, said support having a substantially flat blade supporting surface with a length at least equal to said knife blade predetermined length, said knife blade being adapted to rest on said blade supporting surface with said cutting edge projecting outwardly therebeyond;

the center of said blade supporting surface lying in a plane parallel to and separated from the plane passing through the ends of said blade supporting surface whereby said blade supporting surface presents oppositely sloping surface sections leading to and from the center of said blade supporting surface; and (c) means for attaching said blade tightly against to said blade supporting surface whereby on assembly of said blade with said support, said blade is bent in conformance with said blade supporting surface.

11. The cutter according to claim 10 in which said surface sections lie in planes that intersect at the center of said blade supporting surface.

12. The cutter according to claim 10 in which said one of said knives is movable while the other of said knives is stationary, said one knife blade comprising said movable knife.

13. In combination:

(a) a first knife blade having a generally V-shape such that the ends of said first blade are in a plane parallel to and spaced from the plane passing through the midpoint of said first knife blade, one edge of said first knife blade having a cutting edge.

(b) means supporting said first knife blade for both reciprocating type back and forth movement and for floating type up and down movement;

(c) a second knife blade having a substantially planar surface against which said first knife blade is adapted to slide, the edge of said second knife blade facing said first knife blade cutting edge having a cutting edge so that on back and forth movement of said first knife blade, said first knife blade slides across said second knife blade surface from a retracted position in which said first and second knife blades are open to an extended position in which said first and second knife blades are closed, said first and second knife blade cutting edges cooperating to sever sheet material interposed between said first and second knife blades;

(d) means supporting said second blade in a stationary position;

(e) blade extensions adjacent each end of said first knife blade overlaying said second knife blade surface for supporting said first knife blade on said second knife blade while said first knife blade is retracted, and;

(f) bias means for biasing said first knife blade against said second knife blade to maintain said first and second knife blade cutting edges in cutting relation with one another as said first knife blade slides across said second knife blade.

* * * * *